US007364501B2

(12) United States Patent
Ali et al.

(10) Patent No.: US 7,364,501 B2
(45) Date of Patent: Apr. 29, 2008

(54) SANDING BLOCK AND METHOD OF MAKING SAME

(76) Inventors: Terry Ali, 1671 Grand Portage Trail, Xenia, OH (US) 45385; Christopher Ali, 204 Earlsgate Rd., Beavercreek, OH (US) 45440

( * ) Notice: Subject to any disclaimer, the term of this patent is extended or adjusted under 35 U.S.C. 154(b) by 0 days.

(21) Appl. No.: 11/426,341

(22) Filed: Jun. 26, 2006

(65) Prior Publication Data

US 2007/0298698 A1 Dec. 27, 2007

(51) Int. Cl.
*B24D 15/00* (2006.01)

(52) U.S. Cl. ..... 451/534; 451/524; 451/533; 451/537

(58) Field of Classification Search ..... 451/524, 451/533, 534, 537
See application file for complete search history.

(56) References Cited

U.S. PATENT DOCUMENTS 2,414,036 A * 1/1947 Gerhan ..... 451/512
3,021,649 A * 2/1962 Robbins ..... 451/534
4,887,396 A * 12/1989 Lukianoff ..... 451/523
5,007,483 A * 4/1991 McGuire ..... 168/48.1
6,062,967 A * 5/2000 Calafut et al. ..... 451/523
6,524,175 B2 2/2003 Beaudry et al.
D480,619 S 10/2003 Koenig, Jr.
D497,092 S * 10/2004 McCarthy ..... D8/90
6,960,125 B2 * 11/2005 Mick ..... 451/525
7,077,737 B2 * 7/2006 Manigel ..... 451/533
2001/0000503 A1 * 4/2001 Beaudry et al. ..... 451/523
2003/0224708 A1 * 12/2003 Koenig, Jr. ..... 451/461
2004/0038634 A1 * 2/2004 McCarthy ..... 451/526
2004/0092219 A1 * 5/2004 Koenig, Jr. ..... 451/523
2006/0135049 A1 * 6/2006 Petersen et al. ..... 451/495

OTHER PUBLICATIONS

Ali Industries, Inc., Sanding Sponges for Sandind Drywall, advertising flyer, Oct. 1, 2001., Fairborn, Ohio United States.

* cited by examiner

*Primary Examiner*—Maurina Rachuba
(74) *Attorney, Agent, or Firm*—R. William Graham

(57) ABSTRACT

A sanding block includes a compressible core having at least one pair of sides characterized such that an abrasive material is adhered to said sides substantially along the surface thereof and having a juncture area defined between said two sides which does not have said abrasive material adhered thereto such that the abrasive material does not run continuously about the sides of the core thereby providing the two sides to be readily compressed toward one another. A method of forming the same is also provided.

5 Claims, 2 Drawing Sheets

FIG. 1

SANDING BLOCK AND METHOD OF MAKING SAME

FIELD OF THE INVENTION

This invention relates to a sanding block and method of making the same. More particularly, this invention relates to a sanding block highly suitable for drywall sanding as well as other uses.

BACKGROUND OF THE INVENTION

Sanding blocks have been in use in various forms for many years. Such blocks include sanding pads and sanding sponges of various sizes, shapes and types. Sanding blocks can be flexible (foam or rubber) or non-flexible (wood, metal, or plastic).

Abrasive blocks can be of a particular abrasive grit throughout the block's entire makeup or made of another material which can be flexible or non-flexible and can employ conventional sandpaper connected thereto by way of clamps or a hook and loop material or the block can have an abrasive coated material, such as abrasive grit, emery sheets, or sandpaper sheets, which are bonded to the cores.

A prior block provides bonding an abrasive grit to a core, made of flexible, compressible, polymeric foam. The sanding block is a six-sided block has two expansive sides, to each of which abrasive grit is bonded, two adjacent sides, to each of which abrasive grit is bonded, and two lateral sides, which do not have abrasive grit and at which the core is exposed. Each adjacent side meets each expansive side at two opposite edges. The block has been formed in a trapezoidal and parallelogram for sanding in corners, however, this has not provided an ideal solution in the art of corner sanding.

A particular problem in the area of corner sanding is inner corner sanding of wall joints where mud is applied to drywall. When pressure is applied by a typical corner sander there is usually a sanding line which is created outwardly from the corner by the edge of the block furthest removed from the corner. This occurs with current blocks even when trying to apply lighter pressure on such outwardly disposed edge. One prior sanding block is tapered at its adjacent sides so that a given one of the opposite edges defines an obtuse angle and so that the other one of the opposite edges defines an acute angle in a range from about 55 degrees to about 70 degrees. The idea here is that the acute angle enables a user holding the sanding block in one hand to sand a surface with the expansive side, as far as another surface intersecting the surface being sanded at a right angle, without scuffing the intersecting surface with the adjacent side meeting the expansive side at the acute angle. However, if the user holding the sanding block in one hand applies uneven pressure, gouging of the surface being sanded can occur easily at the opposite edge, which defines the obtuse angle. Currently, all such sanding blocks have failed to adequately address the problem.

SUMMARY OF THE INVENTION

It is an object to improve sanding blocks.

It is another object to provide a sanding block with improved sanding capabilities.

It is another object to improve corner sanding.

It is another object to minimize sanding lines from occurring on a surface being sanded near a corner of an object.

Accordingly, the present invention is directed to a sanding block having a compressible core wherein at least one pair of sides is characterized such that an abrasive material is adhered to the sides substantially along the surface thereof and there is a juncture area defined between the two sides which does not have the abrasive material adhered thereto such that the abrasive material does not run continuously about the sides of the core thereby providing the two sides to be readily compressed toward one another. In one embodiment, the sanding block is generally in the form a parallelepiped having two expansive abrasive sides, two smaller adjacent sides and two end surfaces, wherein a first expansive side and a first smaller side converge at a first leading edge, a second expansive side and a second smaller side converge at a second leading edge. A first juncture area exists between the first expansive side and the second smaller side and a second juncture area exists between the second expansive side and the first smaller side. In a preferred embodiment, each juncture area can be a chamfered surface interconnecting a respective expansive side and smaller side which are generally disposed at an obtuse angle with respect to one another.

Another aspect of the invention is directed to a method of forming the sanding block. The method includes the steps of (a) providing an elongated compressible core material having a plurality of sides, (b) providing a juncture area between the sides, and (c) providing an abrasive material onto the sides such that the abrasive material does not run continuously about the sides of the core. The step (c) can be performed prior to the step (b). The step (b) can be provided by cutting the core to provide a chamfered surface between the sides. The core can be generally parallelepiped. The method can include the step of transversely cutting the elongated core to form a plurality of sanding blocks. The step (b) can include the step of cutting the elongated core to form said juncture area.

Other objects and advantages will be apparent from reading the following description and viewing the drawings appended hereto.

DETAILED DESCRIPTION OF A PREFERRED EMBODIMENT

Figure 1:
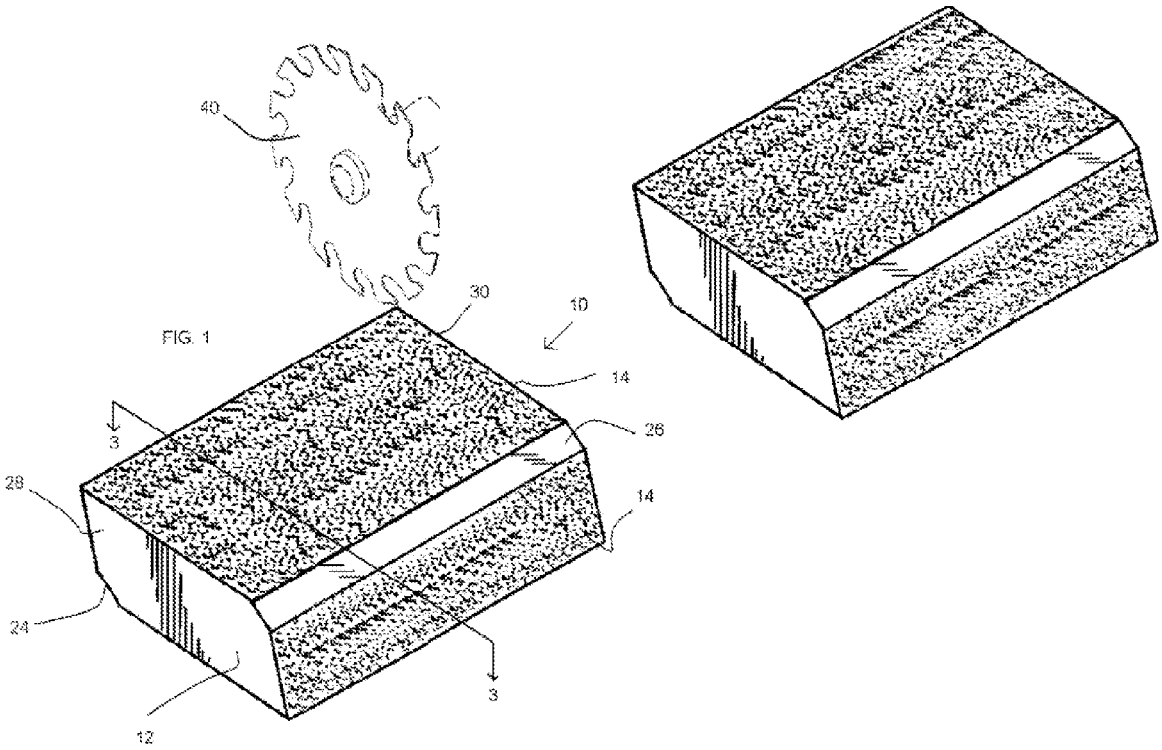
FIG. 1 is a perspective view of a sanding block constituting a preferred embodiment of this invention.
Figure 3:
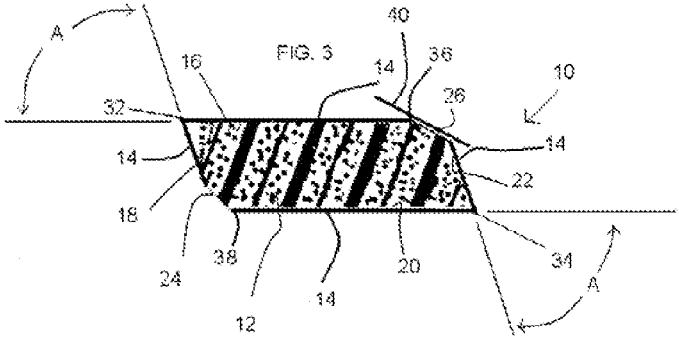
FIG. 3 is a cross sectional view through line 3-3 of the sanding block of FIG. 1.
Figure 4:
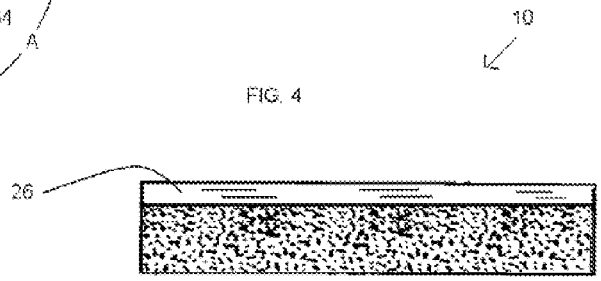
FIG. 4 is a side view of a smaller side of the sanding block of FIG. 1.
Figure 2:
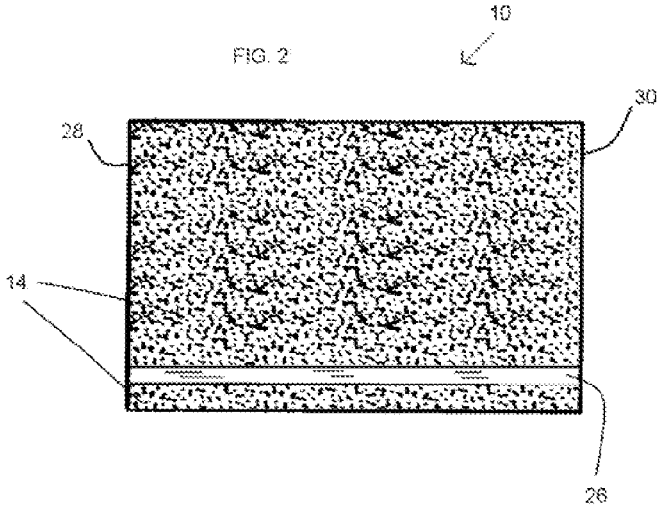
FIG. 2 is a plan view of an expansive side of the sanding block in FIG. 1

Referring now to the drawings, a sanding block according to the invention is generally referred to by the numeral 10. The sanding block 10 has a compressible core 12 wherein an abrasive material 14 is adhered to the sides 16, 18, 20 and 22 substantially along such surfaces of core 12 and there are uncoated sides 24 and 26 which define juncture areas between the sides 16 and 22 and 18 and 20, respectively, which do not have the abrasive material 14 adhered thereto such that the abrasive material 14 does not run continuously about the sides 16, 20, 18 and 22 of the core 12 thereby providing the sides 16 and 20 and 18 and 22 to be readily compressed adjacent the juncture areas at sides 24 and 26.

The sanding block 10 is generally in the form a parallelepiped, being slightly modified by the juncture area at sides 24 and 26, where the two abrasive sides 16 and 20 are rectangular and expansive having a first length and first width and having the abrasive material 14 adhered thereto and, two abrasive sides 18 and 22 are smaller and rectangular having a length generally that of the first length and second width and having the abrasive material 14 adhered thereto, uncoated sides 24 and 26 having a length generally that of the first length and third width, and two end surfaces 28 and 30 are truncated trapezoidal and do not have the abrasive material 14 adhered thereto. The expansive abrasive side 16 and smaller abrasive side 18 meet at a first leading edge 32 defining an acute angle (A) in a range from about 40 degrees to about 50 degrees, with an acute angle of about 45 degrees being illustrated.

The expansive abrasive side 20 and smaller abrasive side 22 meet at a second leading edge 34 similarly defining an acute angle (A). The juncture area at side 24 exists between the expansive abrasive side 20 and smaller abrasive side 18 and a juncture area at side 26 exists between the expansive abrasive side 16 and the smaller abrasive side 22. Each juncture area at sides 24 and 26 can be chamfered interconnecting a respective expansive abrasive side and smaller abrasive side (16 and 22 or 18 and 20), which are generally at an obtuse angle with respect to one another. The juncture areas at sides 24 and 26 can be formed by a cutting or shaving process on a parallelepiped.

The core 12 can be made of a flexible, compressible, polymeric foam having the abrasive grit 14 bonded to a select surfaces thereof. While the particular geometric configuration is described, it is contemplated that other configurations employing the novelties of the invention will be readily apparent to those skilled in the art.

As indicated in the drawings, exemplary dimensions enabling a user to hold the sanding block 10 comfortably in one hand are a length (L) about 5 inches, a width (W) of about 3¾ inches, and a thickness (T) of about 1 inch. A problem with prior sanding block designs is that typically the sides are all coated with the abrasive material. As such, the glue and abrasive form with the core material to provide a relatively rigid structure which despite attempts to minimize gouging or scuffing of the surface being sanded with by the expansive side has nevertheless resulted due to uneven pressure being applied by a user holding the sanding block. Thus, the present invention provides for sanding with either of the expansive sides 16 or 20, for example, with trailing edges 36 and 38 being compressible to permit better feathering of joint compound and minimize damage of gouging or scuffing.

A method of forming the sanding block 10 is also provided. The method includes the steps of (a) providing the elongated compressible core 12 material having a plurality of sides 16, 18. 20 and 22; (b) providing a juncture area at the sides 24 and 26; and (c) providing an abrasive material 14 onto the sides such that said abrasive material does not run continuously about the sides of the core 12. The step (c) can be performed prior to the step (b). The step (b) can be provided by cutting the core 12 to provide a chamfered surface between the sides 16, 22, 26 and 18, 20, 24. The core can be generally parallelepiped. The method can include the step of transversely cuffing the elongated core to form a plurality of sanding blocks. The step (b) can include the step of cutting the elongated core to form said juncture area. In the case where the chamfer is formed after the abrasive material is provided on the sides 14 and 22 as stated above, for example, the abrasive sides 16 and 22 are cut or shaved to form juncture area at side 26 providing tapered abrasive thickness at trailing edges 36.

The sanding block 10 is particularly well suited for drywall-finishing uses as well as for fiberglass-finishing, metal-finishing, wood-finishing, and other uses. While the above described embodiments are set forth by way of example, they are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A sanding block, which comprises:

a compressible core having at least one pair of abrasive sides characterized such that an abrasive material is adhered to said sides substantially along the surface thereof, at least one uncoated side forming part of a juncture area defined between said pair of sides which does not have said abrasive material adhered thereto and two end surfaces displaced from one another and each connecting said sides and wherein each end surface does not have the abrasive material adhered thereto such that said abrasive material does not run continuously about said sides and said end surfaces of said core thereby enabling said sides to be readily compressed toward one another and wherein a trailing edge of one of said abrasive sides and said uncoated side are chamfered to provide a chamfer spanning a length of said trailing edge and said juncture area thereby providing a tapered thickness of abrasive grit along said trailing edge on said one abrasive side and wherein said chamfer trailing edge is formed by one of cutting and shaving after said abrasive material is adhered to said abrasive sides.

2. The sanding block of claim 1, wherein said sanding block includes two pair of abrasive sides and is generally in the form a truncated parallelepiped having two expansive abrasive sides, two smaller adjacent abrasive sides and two end surfaces, wherein a first expansive abrasive side and a first smaller abrasive side converge at a first leading edge, a second expansive abrasive side and a second smaller abrasive side converge at a second leading edge.

3. The sanding block of claim 2, wherein a first juncture area exists between said first expansive abrasive side and said second smaller abrasive side and a second juncture area exists between said second expansive abrasive side and said first smaller abrasive side.

4. The sanding block of claim 2, wherein said first expansive abrasive side and said first smaller abrasive side are generally disposed at an acute angle with respect to one another.

5. The sanding block of claim 4, wherein said second expansive abrasive side and said second smaller abrasive side are generally disposed at an acute angle with respect to one another.

* * * * *